United States Patent [19]

Klatt et al.

[11] Patent Number: 4,773,300

[45] Date of Patent: Sep. 27, 1988

[54] THREE-POSITION WORKING CYLINDER HAVING DUAL CONCENTRIC PISTONS

[75] Inventors: Alfred Klatt, Wathlingen; Karlheinz Brinkmann, Hanover, both of Fed. Rep. of Germany

[73] Assignee: WABCO Westinghouse Fahrzeugbremsen GmbH, Hanover, Fed. Rep. of Germany

[21] Appl. No.: 658,334

[22] Filed: Oct. 5, 1984

[30] Foreign Application Priority Data

Oct. 8, 1983 [DE] Fed. Rep. of Germany ..... 3336682
Oct. 19, 1983 [DE] Fed. Rep. of Germany ..... 3337969

[51] Int. Cl.[4] ..... F01B 7.20; F01B 7/00

[52] U.S. Cl. ..... 91/169 R; 91/440; 91/454; 92/52; 92/62; 92/65

[58] Field of Search ..... 92/13.1, 13.6, 51, 52, 92/62, 65, 82, 86.5; 91/152, 167 R, 169, 170 R, 165, 166, 454, 463, 465, 440, 441; 285/27, 230, 231, 345

[56] References Cited

U.S. PATENT DOCUMENTS

| | | | |
|---|---|---|---|
| 787,479 | 4/1905 | Tanner | 92/62 |
| 787,480 | 4/1905 | Tanner | 92/62 |
| 1,867,478 | 7/1932 | Stelzner | 137/854 X |
| 2,098,885 | 11/1937 | Safford | 137/854 X |
| 2,174,503 | 9/1939 | Whipple | 137/854 X |
| 2,299,211 | 10/1942 | Clench | 92/62 X |
| 3,153,522 | 10/1964 | Piper et al. | 91/167 X |
| 3,327,379 | 6/1967 | Clements | 285/27 X |
| 3,667,785 | 6/1972 | Kapeker | 285/345 X |
| 3,673,926 | 7/1972 | Mohri | 92/51 |
| 3,791,262 | 2/1974 | Staehlin et al. | 92/62 X |
| 4,007,845 | 2/1977 | Worback | 91/420 X |
| 4,416,187 | 11/1983 | Nystrom | 91/454 X |
| 4,522,031 | 6/1985 | Kytta et al. | 60/547.1 |

FOREIGN PATENT DOCUMENTS

| | | | |
|---|---|---|---|
| 64641 | 4/1982 | European Pat. Off. | 92/13.1 |
| 830896 | 8/1938 | France . | |
| 2133893 | 1/1972 | Fed. Rep. of Germany . | |
| 3107908 | 9/1982 | Fed. Rep. of Germany . | |
| 543455 | 5/1956 | Italy | 92/51 |
| 57-163706 | 10/1982 | Japan | 91/437 |

*Primary Examiner*—Robert E. Garrett
*Assistant Examiner*—George Kapsalas
*Attorney, Agent, or Firm*—J. O. Ray, Jr.

[57] ABSTRACT

A fluid-pressure-operated, three position working cylinder includes a cylindrical housing having a graduated bore formed therein and a movable primary piston dividing the bore into first and second pressure chambers. A movable secondary piston surrounds a portion of the primary piston and moves relative to the primary piston within the limits of a piston stop arrangement formed on opposing surfaces of the pistons. The piston stop arrangement includes an elastic stop on the primary piston which interacts with a sloped stop formed on the secondary piston so that upon initial insertion of the secondary piston onto the primary piston, the sloped stop compresses the elastic stop. The sloped stop includes a lip portion that can contact the elastic stop so as to restrain the secondary piston from further movement in one direction relative to the primary piston. A vent passage formed in the housing allows venting of the space between the two pistons. Pressurizing valves control the venting and pressurizing operations of the working cylinder. A check valve covering the vent passage prevents dirt and moisture from invading the graduated bore and piston space.

16 Claims, 2 Drawing Sheets

THREE-POSITION WORKING CYLINDER HAVING DUAL CONCENTRIC PISTONS

BACKGROUND OF THE INVENTION

1. Field of the Invention

This invention relates to a three-position working cylinder having dual concentric pistons and a piston rod extending from the pistons for attachment to an external device to be controlled to such three positions, such an external device possibly being a ventilation flap on a passenger vehicle. Typical three-position working cylinders provide an auxiliary piston disposed on a primary center piston.

2. Brief Description of the Prior Art

An example of such an approach can be found in German Pat. No. DE3107908, which includes a cylinder having a first piston disposed therein such that the cylinder is divided into a first pressure chamber on one side of the first piston, and a second pressure chamber located on the opposite side of the first piston. A piston rod extends from the first piston and a second piston designed as an annular piston is disposed on the first piston, and can be moved in a sealed manner. The second piston is moved against the graduation of the cylinder housing, which defines a middle position. Two stops provided on the first piston serve to limit the relative movement between the two pistons in such a manner that the second piston can be moved between the stops relative to the first piston. An end stop, located in the end region of the first piston when the first piston is activated by means of the piston rod, prevents the second piston from coming loose from the first piston. This end stop, similar to the second stop, is designed as a circlip ring. The disadvantage of such an approach is that, during the assembly of this work cylinder, first the second piston must be pushed onto the first piston, and then the circlip rings must be installed for the above-mentioned end stop. Another known three-position work cylinder is German Pat. No. DE1576175, which provides that, when the two pistons are in motion, a vent opening is provided in the cylinder wall leading to the atmosphere from the chamber formed between the two pistons. Such chamber and vent opening arrangement are primarily designed to prevent the formation of an impact pressure or a vacuum in the space between the two pistons. Such a vent opening has the disadvantage that moisture and dirt can penetrate the cylinder. Even if an attempt were made to prevent the penetration of moisture and dirt by placing a check valve at the vent opening to atmosphere, then the disadvantage of a vacuum formation would again result.

SUMMARY OF THE INVENTION

It is therefore, an object of the invention to provide a three-position working cylinder in which the assembly and manufacture of the work cylinder, especially the assembly of the dual piston arrangement, is simplified.

It is a further object of the invention to provide a telescoping arrangement between the first and second pistons such that a more compact configuration is achieved.

It is yet a further object of the invention to provide a three-position working cylinder whereby the space between the two pistons can be vented without experiencing an impact pressure or a vacuum in such space and yet still preventing dirt or moisture from entering that space.

An even further object of the invention is to provide a three-position working cylinder having a feedback-type valve arrangement connected thereto which utilizes fluid pressure from the chamber being vented to assist movement of the piston into this vented chamber.

Briefly, the invention consists of a graduated cylinder having a primary piston movable therein, a piston rod extending from the primary piston externally of the cylinder for attachment to the device to be controlled, and first and second pressure chambers formed on opposite sides of the primary piston. A second piston is connected to the primary piston by pushing the second piston over a first stop disposed on the primary piston. This first stop is made of a flexible sealing material, while the forward edge of the second piston has a leading sloped portion which compresses this flexible stop, and an inward-directed lip portion that, after passing over the flexible stop, allows the flexible stop to snap back to its original stop form. The second piston is pushed onto the first piston until the forward edge of the second piston contacts a second rigid stop integrally formed on the first piston. A third stop extends radially outward from the second piston and contacts a graduated surface formed internally of the cylinder housing, thus limited movement of the second piston to a portion of the travel of the first piston. A vent opening connects the space between the first and second pistons to atmosphere such that an impact pressure or a vacuum is not created by relative movement of the two pistons. A check valve can be attached to the cylinder housing over the vent opening to prevent dirt or moisture from entering the cylinder, the check valve having a flexible disk portion which is opened by exhausted fluid pressure fed back to the check valve. A multiple solenoid valve arrangement can be constructed such that fluid pressure is directed to the cylinder to control the venting and pressurization of the first and second pressure chambers, and to direct the vented fluid pressure to one of the pressure chambers to assist in movement of the piston.

DESCRIPTION OF THE PREFERRED EMBODIMENT

Figure 1:
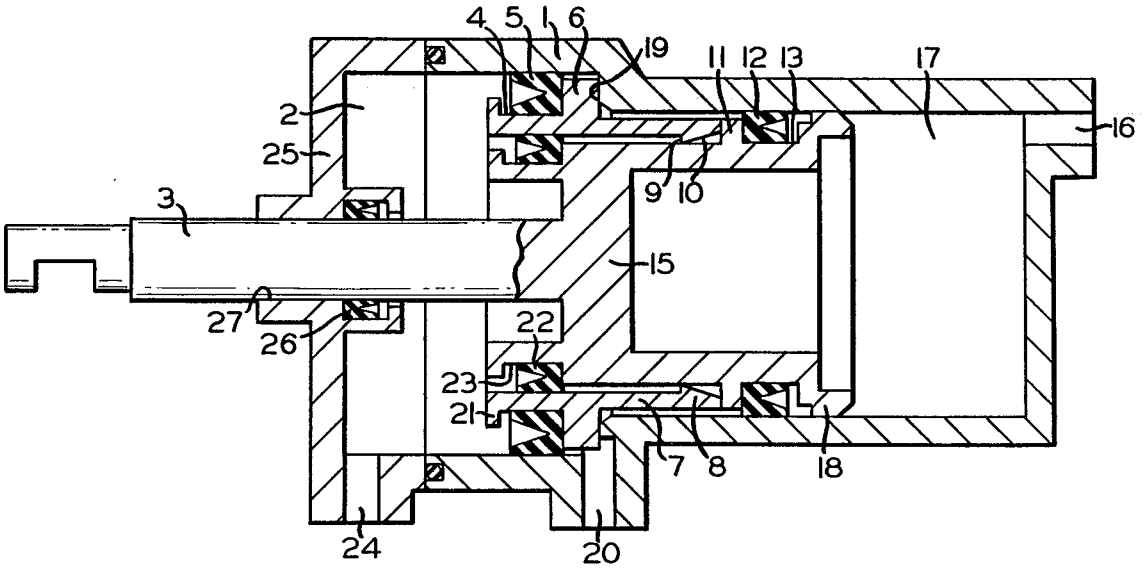
FIG. 1 is an elevational view in section of a three-position working cylinder constructed in accordance with the invention.

As seen in FIG. 1, a three-position working cylinder includes a graduated cylindrical housing 1 in which a primary piston 15 is reciprocably movable. The primary piston 15 separates the cylinder into a first pressure chamber 2, and a second pressure chamber 17 formed in the cylindrical housing 1 on opposite sides of the primary piston 15. A piston rod 3 extends from the primary piston 15 through a rod opening 27 formed in an end cap member 25 of the cylindrical housing 1 such that a control device (not shown) can be secured thereto. The end cap member 25 is secured to the cylindrical housing 1 in such a manner that, during assembly, the entire cross-sectional area of the first pressure chamber 2 is accessible. As seen in FIG. 1, the graduation in the cylindrical housing 1 results in the first pressure chamber 2 having a larger cross-sectional area than the second pressure chamber 17 thus facilitating insertion of the piston assembly through the housing end on which the end cap 25 secures. A rod sealing member 26 is disposed between the cylindrical housing 1 and the end cap member 25 to insure integrity of the first pressure chamber 2. The first and second pressure chambers 2, 17 can be pressurized and ventilated by means of a respective first and second pressure connections 24, 16.

The primary piston 15 exhibits a circular guide 18 at the end opposite the piston rod 3. The circular guide 18 is in sliding contact with the inner surface of the cylindrical housing 1. One side of the circular guide 18 also serves as a portion of a first sealing groove 13 in which is disposed a first slotted seal 12, the first slotted seal 12 serving to prevent fluid pressure from escaping the second pressure chamber 17 to the first pressure chamber 2. The first sealing groove 13 also includes a second wall portion which forms a second barrier against slippage of the first slotted seal 12, this second wall portion being formed by a portion of a rigid stop 11 formed circumferentially around the primary piston 15 near the circular guide 18.

On the primary piston 15, there is a second piston 7 designed as an annular piston which can move relative to the primary piston 15. The second piston 7 has a circular projection 6 which extends radially outward, by means of which the second piston 7, during a movement in the direction of the second pressure chamber 17, can be brought into contact against a housing stop 19, which is an integral part of the housing of the cylindrical housing 1. The housing stop 19 is formed at the graduation of the cylindrical housing 1, and is instrumental in the attachment of the second piston 7 to the primary piston 15. The housing stop 19 also defines the middle position of the working cylinder; when fluid pressure to the first and second pressure chambers 2, 17 is equivalent, the circular projection 6 of the second piston 7 will contact the housing stop 19 such that the primary piston 15 and the second piston 7 are held in this middle position. A second sealing groove 4 is formed on the second piston 7, having sides which are formed on the one hand by the circular projection 6, and on the other hand by a second circular projection 21, which is provided on the side of the second piston 7 facing the first pressure chamber 2. A second slotted seal 5 is disposed in the second seal groove 4 to prevent fluid pressure from escaping the first pressure chamber 2 to the second pressure chamber 17.

In order to seal the chamber between the primary piston 15 and the second piston 7, there is an additional seal designed as a third slotted seal 22, which is disposed between the surface of the primary piston 15 and the inner wall of the second piston 7. The third slotted seal 22 is housed, in this example, in a third sealing groove 23, provided on the surface of the primary piston 15, which groove 23 is located in the end region of the primary piston 15, facing the first pressure chamber 2.

The second piston 7 has, in its end region facing the primary piston 15, a sloped projection 8, which extends radially inward in the direction of the surface of the primary piston 15. This sloped projection 8 is preferably circular, thereby extending around the external circumference of the primary piston 15, and creating a sliding contact between the primary piston 15 and the second piston 7. The sloped projection 8 serves as part of a first piston stop, which interacts with the third slotted seal 22, disposed on the primary piston 15, and facing the first pressure chamber 2. The sloped projection 8 is constructed such that, on the side facing the third slotted seal 22, a lip edge 9 is formed, and on the side away from the third slotted ring 22 a ramp portion 10 is formed.

A vent passage 20 is formed in the cylindrical housing 1 to allow ventilation of the space between the primary piston 15 and the second piston 7, thereby preventing the occurrence of an impact pressure or a vacuum in this space.

During assembly of the three-position working cylinder, the second piston, designed as an annular piston, is pushed over the primary piston 15, from the direction of the end of the primary piston 15 having the piston rod 3 extending therefrom. During this process, the third slotted seal 22 is elastically deformed by the sloped projection 8 of the second piston 7. When the sloped projection 8 has passed over the third slotted seal 22, the third slotted seal 22 will assume its original shape. The pushing of the second piston 7 onto the primary piston 15 can be accomplished without the use of special tools since the sloped projection 8, formed on the second piston 7, exhibits the sloped ramp portion 10 which, when the second piston 7 is being pushed onto the primary piston 15, serves to elastically deform the third slotted seal 22. A separation of the two pistons 7, 15 is only possible without the use of special tools if damage to the third slotted seal 22 is acceptable since, the lip edge 9 of the sloped projection 8, which faces the third slotted seal 22 after assembly, will damage the third slotted seal 22 when being passed over in the direction required for disassembly.

In operation, it will be assumed that it is desired to have the three-position working cylinder in the middle position, as shown in FIG. 1. To achieve this middle position, the fluid pressure levels in the first and second pressure chambers 2, 17 are equivalent. The circular projection 6 of the second piston 7 contacts the housing stop 19 such that the second piston 7 will remain at rest. The rigid stop 11, formed on a primary piston 15, will contact the sloped projection 8 of the second piston 7 such that the primary piston 15 remains pressed against the second piston 7. Since the sum of the effective piston surfaces of the primary piston 15 and second piston 7, acted upon by the fluid pressure within the first pressure chamber 2, is greater than the opposite effective piston surfaces of the primary piston 15 acted upon by the fluid pressure from the second pressure chamber 17, the primary piston 15 connected with the piston rod 3 remains in the middle position.

If the primary piston 15 connected with the piston rod 3 is to be brought into its left-hand-most limit position, then the first pressure chamber 2 is ventilated. The primary piston 15 is then urged in the left-hand direction by the fluid pressure from the second pressure chamber 17, and by means of the rigid stop 11 formed on the primary piston 15 urges the second piston 7 along therewith.

If the primary piston 15 is to be placed in the right-hand-most limit position, and therefore the piston rod 3 is to be inserted into the cylindrical housing 1, the second pressure chamber 17 is ventilated and the first pressure chamber 2 is pressurized. Both the primary piston 15 and the second piston 7 are to be moved by the fluid pressure from the first pressure chamber 2 in the direction of the second pressure chamber 17. The second piston 7 comes into contact by means of the circular projection 6 with the housing stop 19, which is an integral part of the cylindrical housing 1, and the primary piston 15 continues on to its right-hand-most limit position.

If it is desired to return to the middle position, the second pressure chambe 17 must again be pressurized with fluid pressure. The primary piston 15 will be urged by the fluid pressure from the second pressure chamber 17 in a left-ward direction, toward the first pressure chamber 2, until the primary piston 15, by means of its rigid stop 11, comes into contact with the sloped projection 8 of the second piston 7, which is facing it.

It can be appreciated that, by connecting the primary piston 15 and the second piston 7 in the above-described manner, an inadvertent uncoupling of the two pistons 7, 15 is prevented. It can further be seen that, in the absence of fluid pressure in the first and second pressure chambers 2, 17, manually moving the piston rod 3 will move the primary piston 15 independent of the second piston 7 only within the limits provided by their respective interacting stops formed on the primary piston 15 and the second piston 7.

The travel of the primary piston 15 within the second piston chamber 17 is limited to an amount whereby the third slotted seal 22 just contacts the lip edge 9 of the sloped projection 8 without there being an excessive pressure between such two surfaces.

Figure 2:
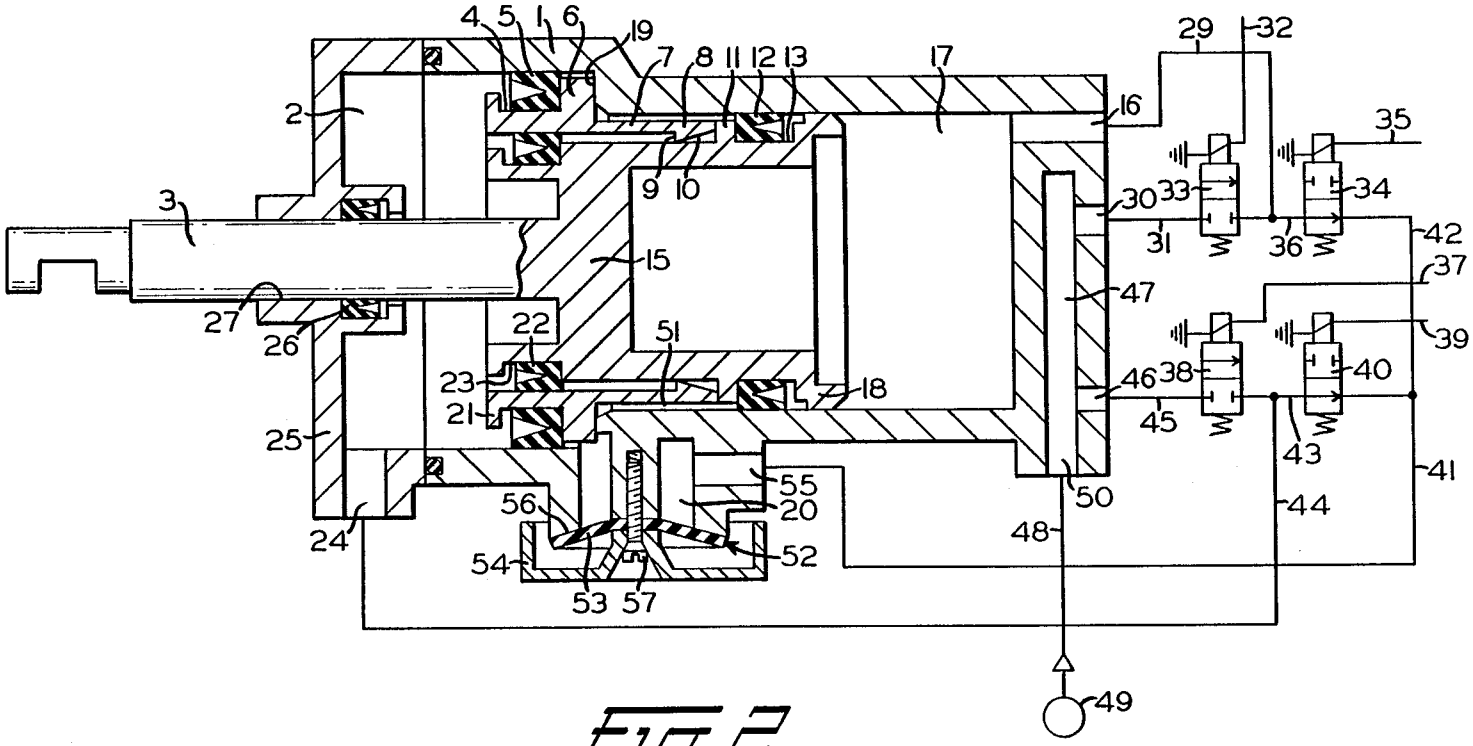
FIG. 2 is an elevational view partly in section and partly diagrammatic of a three-position working cylinder having a valve pressurization arrangement constructed in accordance with the invention.

As seen in FIG. 2, a three-position working cylinder can be provided having a pressurization and ventilation valve arrangement, as well as a check valve arrangement used for venting the space between the two pistons, whereby all other components as described in FIG. 1 remain the same, and for which a detailed discussion need not be advanced therefor.

The above-mentioned ventilation, pressurization valve arrangement receives fluid pressure from a fluid pressure source 49, which first directs the fluid pressure over a supply line 48 and to a pressure distribution channel 47, formed in the cylindrical housing 1 at the end of the cylindrical housing 1 adjacent the second pressure chamber 17. The pressure distribution channel 47 has a pressure inlet 50 and a first and second pressure outlet 46, 30.

The first pressure outlet 46 is connected by means of a first pressure line 45 to an inlet of the first inlet valve 38. The outlet of the first inlet valve 38 is connected via a second pressure line 44 with the first pressure chamber 2 by means of the first pressure connection 24. A third pressure line 43 branches off from the second pressure line 44 and leads to the inlet of the first discharge valve 40. The outlet of the first discharge valve 40 is connected via a fourth pressure line 42 and a third pressure connection 55 with the piston space 51 defined between the primary piston 15 and the second piston 7. The inlet valve 38 and the outlet valve 40 are designed as solenoid valves whereby first and second electrical lines 37, 39 and a control apparatus (not shown) can be provided to operate the inlet valve 38 and outlet valve 40, according to a predetermined set of conditions.

In the same manner, the second pressure outlet 30 of the flow pressure distributor 47 is connected via a fifth pressure line 31, with the inlet of a second inlet valve 33. The outlet of the second inlet valve 33 is connected via a sixth pressure 29 to the second pressure connection 16, corresponding to the second pressure chamber 17. Via a seventh pressure line 36, which branches off from the sixth pressure line 29, the second pressure connection 16 is connected with the inlet of a second outlet valve 34. The outlet of the second outlet valve 34 is connected by means of an eighth pressure line 41 with the fourth pressure line 42 and thus the pressure connection 55 with the piston space 51 defined between the two pistons 15, 7. The second inlet valve 33 and the second outlet valve 34 are designed as solenoid valves whereby third and fourth electrical lines 32, 35 and a control apparatus (not shown) can be provided to operate the second inlet valve 33 and the second outlet valve 34, according to such predetermined set of conditions.

The piston space 51 defined between the primary piston 15 and the second piston 7 can be connected via a third valve apparatus designed as a check valve 52 with atmosphere. The check valve 52 is, in this example, formed by an elastic disc 53 and a housing projection designed as a valve seat 56 which defines the vent passage 20, whereby the elastic disc 53 is attached by means of a screw 57 to a projection of the cylindrical housing 1. By means of the screw 57, the retaining force of the check valve 52 can be adjusted. The check valve 52 is protected against external influence by a valve cap 54, which is also held in place by the screw 57. It should be noted that the vent passage 20 is annular around the housing projection on which the screw 57 is attached, and that the vent passage 20 is in communication with the piston space 51 when the circular projection 6 of the second piston 7 is not in contact with the housing stop 19.

In operation, it will be assumed that it is desired to have the three-position working cylinder in the middle position as shown in FIG. 2. To achieve this middle position, there must be equivalent amounts of fluid pressure in the first and second pressure chambers 2, 17. The circular projection 6 of the second piston 7 contacts the housing stop 19 such that the second piston 7 remains at rest. The rigid stop 11 formed on the primary piston 15 will contact the sloped projection 8 of the second piston 7 such that the primary piston 15 remains pressed against the second piston 7. Since the sum of the effective piston surfaces of the primary piston 15 and the second piston 7, acted on by fluid pressure in the first pressure chamber 2, is greater than the opposite effective piston surface of the primary piston 15, acted on by fluid pressure in the second pressure chamber 17, the primary piston 15, along with the piston rod 3 will remain in the middle position.

If the primary piston 15 is to be moved to its left-hand-most position, the first pressure chamber 2 is vented, and the primary piston 15 is urged left-ward by the fluid pressure in the second pressure chamber 17. The second piston 7 will be urged along with the primary piston 15 by engagement of the rigid stop 11 and the sloped projection 8 of the second piston 7. The ventilation, pressurization of the respective first and second pressure chambers 2, 17, to achieve this left-ward movement of the primary piston 15 and second piston 7, begins by closing the first inlet valve 38 and opening the first outlet valve 40. The evacuation of the first pressure chamber 2 occurs over the third and fourth pressure lines 43, 44, the opened first outlet valve 40, and the fourth pressure line 42, which directs the exhausted fluid pressure into the vent passage 20, which is closed off from atmosphere by the check valve 52, and finally to the piston space 51, defined between the primary piston 15 and second piston 7. If the fluid pressure in the piston space 51 and in the vent passage 20 has increased to the point that it overcomes the retaining force of the check valve 52, the check valve 52 opens and the excess pressure is discharged to atmosphere.

If the primary piston 15 is to be moved to its right-hand-most position, and thus the piston rod 3 is to be inserted into the cylindrical housing 1, the first inlet valve 38, the second inlet valve 33, the first outlet valve 40, and the second outlet valve 34 are all reversed The first inlet valve 38 is now in the open position, and the first outlet valve 40 is closed. The second inlet valve 33, corresponding to the second pressure chamber 17, is now closed, and the second outlet valve 34, corresponding to the second pressure chamber 17, is now open.

The fluid pressure which builds up in the first pressure chamber 2 will urge the primary piston 15 and the second piston 7 in the right-ward direction toward the second pressure chamber 17. The second piston 7 comes, with its circular projection 6, into contact with the housing stop 19, which is integral with the cylindrical housing 1, and the primary piston 15 continues to travel until it reaches its right limit position. During this process, the second pressure chamber 17 is evacuated via the sixth and seventh pressure lines 29, 36, the open outlet valve 34, and the eighth pressure line 41 into the vent passage 20, which is closed from atmosphere by the check valve 52, as well as the piston space 51, which is defined between the primary piston 15 and the second piston 7. As in the case of venting the first piston chamber 2, if the pressure in the piston space 51 and the vent passage 20 has increased during venting of the second pressure chamber 17 to the point that it overcomes the retaining force of the check valve 52, the check valve 52 opens and the excess pressure is discharged to atmosphere.

If it is desired to return to the middle position, the second outlet valve 34 is closed, the second inlet valve 33 is placed in the open position, and thus the second pressure chamber 17 is again pressurized. The primary piston 15 will be urged by the fluid pressure out of the second pressure chamber 17 in a left-ward direction toward the first pressure chamber 2 until the rigid stop 11 comes into contact with the sloped projection 8 of the second piston 7. The fluid pressure in the piston space 51, as defined between the primary piston 15 and the second piston 7, and the vent passage 20 is discharged to the atmosphere via the check valve 52.

Although the hereinabove-described forms of embodiments of the invention constitute preferred forms, it can be appreciated that other modifications may be made thereto without departing from the scope of the invention, as set forth in the appended claims.

We claim:

1. A fluid-pressure-operated, three-position working cylinder for controlling an external device to any one of three distinct positions, said working cylinder comprising:

(a) a cylindrical housing having formed therein a graduated bore with an annular surface formed at a graduation of said graduated bore;

(b) a primary piston, reciprocally movable in said graduated bore, divides said graduated bore into first and second pressure chambers located on opposite sides of said primary piston, said first pressure chamber being of a larger cross-sectional area than said second pressure chamber, said primary piston having sealing means for sealing said second chamber;

(c) a secondary piston reciprocally movable within said graduated bore and disposed around at least a portion of said primary piston, said secondary piston being movable relative to said primary piston, said secondary piston having sealing means for sealing said first chamber;

(d) connecting means secured to said primary piston and extending through said first pressure chamber and out of a first end of said cylindrical housing adjacent said first pressure chamber for connecting such external device thereto to be controlled to such three positions;

(e) piston stop means formed partially on and extending radially outwardly of said primary piston and formed partially on and extending radially inwardly of said secondary piston for limiting a relative positioning between said primary and secondary pistons among distinct positions according to such fluid pressure as is present in said first and second pressure chambers, said piston stop means including an elastic stop member disposed on said primary piston and a sloped stop formed on said secondary piston in opposing relation to said elastic stop, said sloped stop member compressing said elastic stop member during insertion of said secondary piston onto said primary piston, said sloped stop further having an inner lip portion that, following insertion of said secondary piston onto said primary piston, at times, contacts said elastic stop member such that said secondary piston is restrained from further movement in one linear direction relative to said primary piston, said elastic stop member acting as a dynamic seal between said primary piston and said secondary piston during relative movement of said primary piston and said secondary piston;

(f) a vent passage formed in said cylindrical housing in communication with a space formed between said primary and said secondary pistons, such that said space can be vented to atmosphere; and (g) an end cap member secured to said first end of said cylinder housing adjacent said first pressure chamber and having an opening through which said connecting means extends, said end cap further being of a dimension such that removal of said end cap allows access to such cross-sectional area of said first pressure chamber, such access allowing insertion of said primary piston and said secondary piston into said graduated bore from said first end.

2. A three-position working cylinder, as set forth in claim 1, wherein said connecting means includes a piston rod secured to said primary piston and extending externally of said cylindrical housing.

3. A three-position work cylinder, as set forth in claim 1, wherein said primary piston and said secondary piston reside at least partially in said first pressure chamber such that fluid pressure introduced to said first pressure chamber acts simultaneously on said primary and secondary pistons to urge said primary and secondary pistons in a first direction.

4. A three-position working cylinder, as set forth in claim 1, wherein said primary piston has formed at a second end adjacent said second pressure chamber, a circular guide portion in sliding contact with said graduated bore.

5. A three-position working cylinder, as set forth in claim 4, wherein said circular guide portion and a portion of said piston stop means form a second sealing groove on said primary piston, said second sealing groove having disposed therein a slotted seal which seals said second pressure chamber from said first pressure chamber.

6. A three-position working cylinder, as set forth in claim 1, wherein said elastic stop member is a grooved sealing ring residing in a sealing groove formed circumferentially on said primary piston at a first end of said primary piston adjacent said first pressure chamber.

7. A three-position working cylinder, as set forth in claim 6, wherein said piston stop means further includes a second stop member formed circumferentially around said primary piston at a second end of said primary piston adjacent said second pressure chamber, said second stop member being of a rigid construction.

8. A three-position working cylinder, as set forth in claim 7, wherein said piston stop means further includes a third stop member formed circumferentially around said second piston member, said third stop at times contacting a housing stop formed in said graduated bore by said annular surface.

9. A fluid-pressure-operated three-position working cylinder for controlling an external device to any one of three distinct positions, said working cylinder comprising:

(a) a cylindrical housing having formed therein a graduated bore with an annular surface formed at a graduation of said graduated bore;

(b) a primary piston, reciprocally movable within said graduated bore, divides said graduated bore into first and second pressure chambers formed on opposite sides of said primary piston;

(c) a secondary piston reciprocally movable within said graduated bore and disposed around at least a portion of said primary piston, said secondary piston being movable relative to said primary piston;

(d) connecting means connected to said primary piston for securing to such external device such that such external device is positioned coincident with said primary piston;

(e) piston stop means formed partially on said primary piston and partially on said secondary piston for limiting a relative positioning between said primary piston and said secondary piston among distinct positions according to such fluid pressure as is present in said first and second presssure chambers, said piston stop means includes a first elastic stop member disposed circumferentially around said primary piston and a sloped stop member formed on said secondary piston in opposing relation to said first elastic stop member, said sloped stop member compressing said first elastic stop member during insertion of said secondary piston onto said primary piston, said sloped stop member further having an inner lip portion that, following insertion of said secondary piston onto said primary piston, at times, contacts said elastic stop member such that said secondary piston is restrained from further movement relative to said primary piston;

(f) a vent passage formed in said cylindrical housing in communication with a space formed between said primary and said secondary pistons;

(g) an end cap member secured to said first end of said cylinder housing adjacent said first pressure chamber and having an opening through which said connecting means extends, said end cap further being of a dimension such that removal of said end cap allows access to such cross-sectional area of said first pressure chamber, such access allowing insertion of said primary piston and said secondary piston into said graduated bore from said first end;

(h) a check valve disposed on said cylindrical housing over said vent passage; and (i) pressurizing valve means in communication with said first and second pressure chambers for selectively pressurizing and venting said first and second pressure chambers such that said primary and secondary pistons are urged to a desired one of such three positions, said pressurizing valve means further being in communication with said vent passage such that, such fluid pressure vented from said first and second pressure chambers communicates with said check valve and said space.

10. A three-position working cylinder, as set forth in claim 9, wherein said pressurizing valve means includes first and second inlet valve in communication with respective first and second pressure chambers such that fluid pressure is directed into said first and second pressure chambers when said respective first and second inlet valves are in an open position, said pressurizing valve means further including first and second outlet valves in communication with said first and second pressure chambers such that fluid pressure is vented from said first and second pressure chambers when said first and second outlet valves are in the respective open positions.

11. A three-position working cylinder as set forth in claim 9, wherein said check valve has an elastic valve member secured to said cylindrical housing and a valve cap secured over said elastic valve member.

12. A three-position working cylinder, as set forth in claim 11, further including a distribution passage formed in said housing in communication with said pressurizing valve means.

13. A three-position working cylinder, as set forth in claim 9, further including a distribution passage formed in said housing in communication with said pressurizing valve means.

14. A three-position working cylinder, as set forth in claim 13, wherein said pressurizing valve means includes first and second inlet valves in communication with respective first and second pressure chambers such that fluid pressure is directed into said first and second pressure chambers when said respective first and second inlet valves are in an open position, said pressurizing valve means further including first and second outlet valves in communication with said first and second pressure chambers such that fluid pressure is vented from said first and second pressure chambers when said first and second outlet valves are in the respective open positions.

15. A three-position working cylinder, as set forth in claim 9, wherein said elastic stop member is a grooved sealing ring residing in a sealing groove formed circumferentially on said primary piston at a first end of said primary piston adjacent said first pressure chamber, said piston stop means further including a second stop member formed circumferentially around said primary piston at a second end of said primary piston adjacent said second pressure chamber, said second stop member being of rigid construction, and a third stop member formed circumferentially around said second piston member, said third stop contacting a housing stop formed in said graduated bore by said annular surface.

16. A three-position working cylinder, as set forth in claim 15, wherein said primary piston has formed at said second end adjacent said second pressure chamber, a circular guide portion in sliding contact with said graduated bore, said circular guide portion and said rigid second stop form a second sealing groove on said primary piston, said second sealing groove having disposed therein a slotted seal which seals said second pressure chamber from said first pressure chamber.

* * * * *

UNITED STATES PATENT AND TRADEMARK OFFICE

CERTIFICATE OF CORRECTION

PATENT NO. : 4,773,300

DATED : September 27, 1988

INVENTOR(S) : Alfred Klatt & Karlheinz Brinkmann

It is certified that error appears in the above-identified patent and that said Letters Patent are hereby corrected as shown below:

Column 10, line 56, before "rigid", insert --a--

Signed and Sealed this

Twenty-fifth Day of April, 1989

*Attest:*

*Attesting Officer*

DONALD J. QUIGG

*Commissioner of Patents and Trademarks*